US007513988B2

(12) United States Patent
Oballa et al.

(10) Patent No.: US 7,513,988 B2
(45) Date of Patent: Apr. 7, 2009

(54) AROMATIC SATURATION AND RING OPENING PROCESS

(75) Inventors: Michael C. Oballa, Cochrane (CA); Vasily Simanzhenkov, Calgary (CA); Jens Weitkamp, Horb a.N (DE); Roger Gläser, Leonberg (DE); Yvonne Traa, Stuttgart (DE); Fehime Demir, Stuttgart (DE)

(73) Assignees: Nova Chemicals (International) S.A. (CH); Universitat Stuttgart (DE)

( * ) Notice: Subject to any disclaimer, the term of this patent is extended or adjusted under 35 U.S.C. 154(b) by 391 days.

(21) Appl. No.: 11/515,018

(22) Filed: Sep. 1, 2006

(65) Prior Publication Data

US 2007/0062848 A1 Mar. 22, 2007

(30) Foreign Application Priority Data

Sep. 20, 2005 (CA) ..... 2520433
Mar. 16, 2006 (CA) ..... 2541051

(51) Int. Cl.
*C10G 45/44* (2006.01)

(52) U.S. Cl. ..... 208/57; 208/58; 208/49; 208/60; 208/61; 208/114; 585/940; 585/266

(58) Field of Classification Search ..... 208/57, 208/68, 60, 144; 585/266, 940
See application file for complete search history.

(56) References Cited

U.S. PATENT DOCUMENTS 4,828,675 A * 5/1989 Sawyer et al. ..... 208/57

* cited by examiner

*Primary Examiner*—Tam M Nguyen
(74) *Attorney, Agent, or Firm*—Kenneth H. Johnson

(57) ABSTRACT

Less conventional sources of hydrocarbon feedstocks such as oil sands, tar sands and shale oils are being exploited. These feedstocks generate a larger amount of heavy oil, gas oil, asphaltene products and the like containing multiple fused aromatic ring compounds. These multiple fused aromatic ring compounds can be converted into feed for a hydrocarbon cracker by first hydrogenating at least one ring in the compounds and subjecting the resulting compound to a ring opening and cleavage reaction. The resulting product comprises lower paraffins suitable for feed to a cracker, higher paraffins suitable for example as a gasoline fraction and mono aromatic ring compounds (e.g. BTX) that may be further treated.

31 Claims, 3 Drawing Sheets

AROMATIC SATURATION AND RING OPENING PROCESS

FIELD OF THE INVENTION

The present invention relates to a concurrent or consecutive process to treat compounds comprising two or more fused aromatic rings to saturate at least one ring and then cleave the resulting saturated ring from the aromatic portion of the compound to produce a $C_{2-4}$ alkane stream and an aromatic stream. More particularly the process of the present invention may be integrated with a hydrocarbon (e.g. ethylene) (steam) cracker so that hydrogen from the cracker may be used to saturate and cleave the compounds comprising two or more aromatic rings and the $C_{2-4}$ alkane stream may be fed to the hydrocarbon cracker. Additionally, the process of the present invention could also be integrated with a hydrocarbon cracker (e.g. steam cracker) and an ethylbenzene unit. Particularly, the present invention may be used to treat the heavy residues from processing oil sands, tar sands, shale oils or any oil having a high content of fused ring aromatic compounds to produce a stream suitable for petrochemical production.

BACKGROUND OF THE INVENTION

There is a continuing demand for lower paraffins such as $C_{2-4}$ alkanes for the production of lower olefins which are used in many industrial applications. In the processing of shale oils, oil sands and tar sands there is typically a residual stream containing compounds comprising at least two aromatic rings. These types of compounds have been subjected to hydrocracking to produce higher alkanes (e.g. $C_{5-8}$ alkanes) that could be used for example to produce fuels.

U.S. Pat. No. 6,652,737 issued Nov. 25, 2003 to Touvellle et al., assigned to ExxonMobil Research and Engineering Company illustrates one current approach to treating a naphthene feed (i.e. having a large amount, preferably 75 weight % of alkanes and cycloparaffin content). The cycloparaffins are subjected to a ring opening reaction at a tertiary carbon atom. The resulting product contains a stream of light olefins (e.g. ethylene and propylene). The present invention uses a different approach. The feed comprises a higher amount of unsaturated and particularly compounds containing two or more fused aromatic rings. The compounds are partially hydrogenated to have at least one ring which is saturated and the resulting product is subjected to a ring opening and cleavage reaction to yield lower (i.e. $C_{2-4}$) alkanes.

Another approach is illustrated by U.S. Pat. No. 4,956,075 issued Sep. 11, 1990 to Angevine et al., assigned to Mobil Oil Corporation. The patent teaches treating gas oil, tar sands or shale oil with an Mn catalyst on a large size zeolite support to yield a higher alkane stream suitable for use in gasoline or alkylation processes. The present invention uses a different catalyst and produces a different product stream.

The present invention seeks to provide a process for treating a feed containing significant portion (e.g. not less than 20 weight %) of aromatic compounds containing two or more fused aromatic rings. One ring is first saturated and then subjected to a ring opening and cleavage reaction to generate a product stream containing lower ($C_{2-4}$) alkanes. The resulting lower alkanes may then be subjected to conventional cracking to yield olefins. In a preferred embodiment the processes are integrated so that hydrogen from the steam cracking process may be used in the saturation and ring opening steps. The process of the present invention will be particularly useful in treating heavy fractions (e.g. gas oils) from the recovery of oil from shale oils or tar sands. It is anticipated such fractions will significantly increase in volume with the increasing processing of these types of resources.

SUMMARY OF THE INVENTION

The present invention seeks to provide a process for hydrocracking a feed comprising not less than 20 weight % of one or more aromatic compounds containing at least two fused aromatic rings which compounds are unsubstituted or substituted by up to two $C_{1-4}$ alkyl radicals to produce a product stream comprising not less than 35 weight % of a mixture of $C_{2-4}$ alkanes comprising concurrently or consecutively:

(i) treating or passing said feed stream in or to a ring saturation unit at a temperature from 300° C. to 500° C. and a pressure from 2 to 10 MPa together with from 100 to 300 kg of hydrogen per 1,000 kg of feedstock over an aromatic hydrogenation catalyst to yield a stream in which not less than 60 weight % of said one or more aromatic compounds containing at least two rings which compounds are unsubstituted or substituted by up to two $C_{1-4}$ alkyl radicals at least one of the aromatic rings has been completely saturated;

(ii) treating or passing the resulting stream in or to a ring cleavage unit at a temperature from 200° C. to 600° C. and a pressure from 1 to 12 MPa together with from 50 to 200 kg of hydrogen per 1,000 kg of said resulting stream over a ring cleavage catalyst; and (iii) separating the resulting product into a $C_{2-4}$ alkanes stream, a liquid paraffinic stream and an aromatic stream.

The present invention also provides in an integrated process for the upgrading of an initial hydrocarbon comprising not less than 5, typically not less than 10 weight % of one or more aromatic compounds containing at least two fused aromatic rings which compounds are unsubstituted or substituted by up to two $C_{1-4}$ alkyl radicals comprising subjecting the hydrocarbon to several distillation steps to yield an intermediate stream comprising not less than 20 weight % of one or more aromatic compounds containing at least two fused aromatic rings which compounds are unsubstituted or substituted by up to two $C_{1-4}$ alkyl radicals the improvement comprising:

(i) passing said intermediate stream to a ring saturation unit at a temperature from 300° C. to 500° C. and a pressure from 2 to 10 MPa together with from 100 to 300 kg of hydrogen per 1,000 kg of feedstock over an aromatic hydrogenation catalyst to yield a stream in which not less than 60 weight % of said one or more aromatic compounds containing at least two rings which compounds are unsubstituted or substituted by up to two $C_{1-4}$ alkyl radicals at least one of the aromatic rings has been completely saturated;

(ii) passing the resulting stream to a ring cleavage unit at a temperature from 200° C. to 600° C. and a pressure from 1 to 12 MPa together with from 50 to 200 kg of hydrogen per 1,000 kg of said resulting stream over a ring cleavage catalyst; and (iii) separating the resulting product into a $C_{2-4}$ alkanes stream, a liquid paraffinic stream and an aromatic stream.

In one embodiment of the invention the treatments are done in one unit and considered concurrent treatment. A draw back of this approach is that the unit has to run at a lower weight hourly space velocity (WHSV). Preferably the processes are carried out consecutively in two separate units which increases the overall WHSV of the process.

In a further preferred embodiment the present invention provides the above process integrated with an olefins cracking process and optionally an ethylbenzene unit.

DETAILED DESCRIPTION

Figure 1:
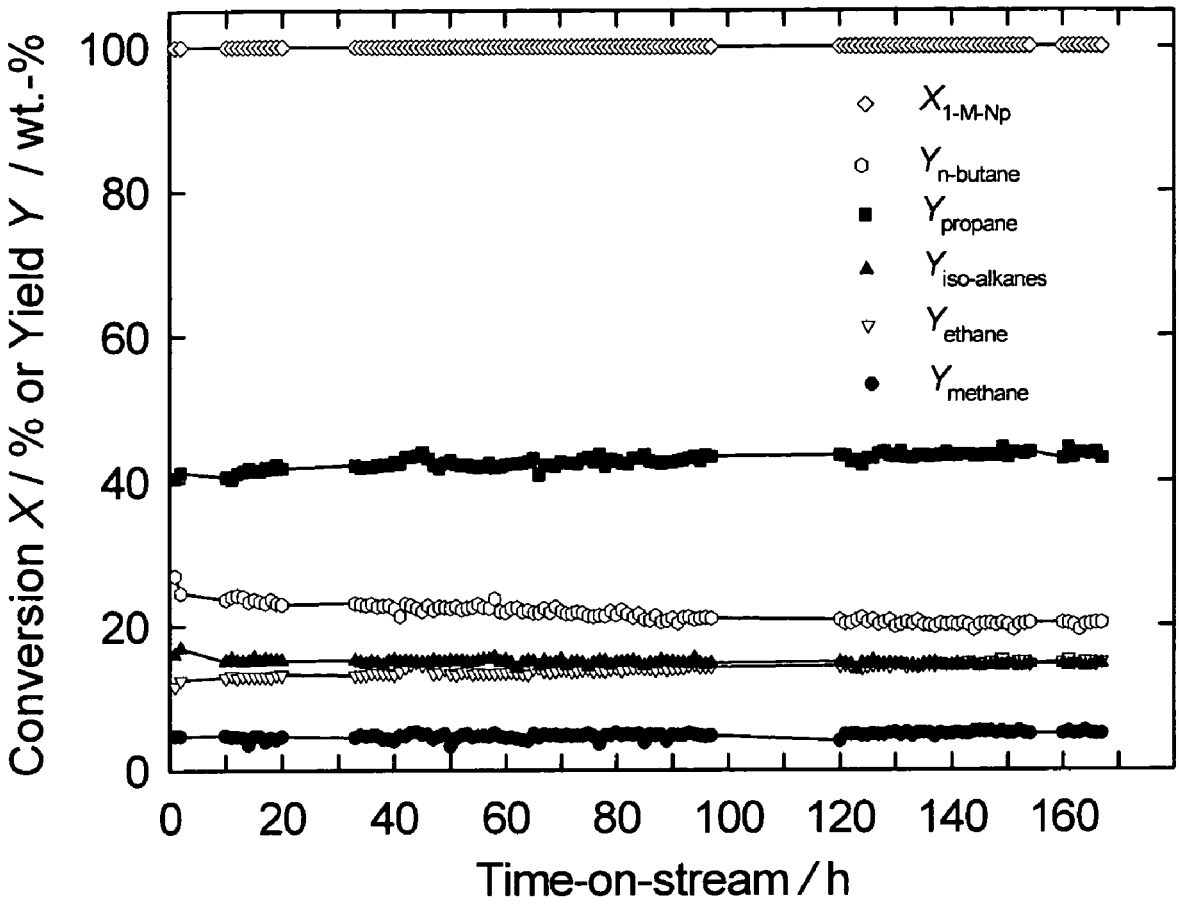
FIG. 1 shows the conversion of methylnaphthalene as a function of time in accordance with example 1.

There is an increasing use of less conventional sources of hydrocarbons such as shale oils and tar or oil sands. As a hydrocarbon source, these materials generally have 5 weight %, typically more than 8 weight %, generally more than 10 weight % but typically not more than about 15 weight % of aromatic compounds. It is anticipated that within the next five years the processing of the Athabasca Tar Sands will result in a significant amount of asphaltenes, residues and products such as vacuum gas oil etc. (e.g. residues/products containing polyaromatic rings particularly two or more aromatic rings which may be fused). The present invention seeks to provide a process to treat/hydrocrack these products to produce lower ($C_{2-4}$) alkanes (paraffins). The resulting alkanes may be cracked to olefins and further processed (e.g. polymerized etc.).

Typically the feedstock for use in the ring saturation/ring opening aspect of the present invention will comprise not less than 20 weight %, preferably, 40 to 55 weight % of two fused aromatic ring compounds and from about 5 to 20, preferably from 8 to 14 weight % of aromatic compounds having three or more fused aromatic rings. The feed may contain from about 10 to 25 weight %, preferably from 12 to 21 weight % of one ring aromatic compounds. The aromatic compounds may be unsubstituted or up to fully substituted, typically substituted by not more than about four, preferably not more than two substituents selected from the group consisting of $C_{1-4}$, preferably $C_{1-2}$ alkyl radicals. The feedstock may contain sulphur and nitrogen in small amounts. Typically nitrogen may be present in the feed in an amount less than 700 ppm, preferably from about 250 to 500 ppm. Sulphur may be present in the feed in an amount from 2000 to 7500 ppm, preferably from about 2,000 to 5,000 ppm. Prior to treatment in accordance with the process of the present invention the feed may be treated to remove sulphur and nitrogen or bring the levels down to conventional levels for subsequent treatment of a feedstock.

Depending on the process used the feedstock may be fed to the first reactor at a weight hourly space velocity (WHSV) ranging from 0.1 to $1\times10^3$ $h^{-1}$, typically from 0.2 to 2 $h^{-1}$ for a concurrent or combined process (carried out in the same reactor) and typically from $1\times10^2$ $h^{-1}$ to $1\times10^3$ $h^{-1}$ for a consecutive process carried out in sequential reactors. (Some processes refer to a Liquid hourly space velocity (LHSV). The relationship between LHSV and WSHV is LHSV=WHSV/stream (average) density).

In the first step of the present invention the feedstock is treated in a ring saturation unit to saturate (hydrogenate) at least one of the aromatic rings in the compounds containing two or more fused aromatic rings. In this step typically not less than 60, preferably not less than 75, most preferably not less than 85 weight % of the polyaromatic compounds have one aromatic ring fully saturated.

Generally the process is conducted at a temperature from 300° C. to 500° C., preferably from 350° C. to 450° C. and a pressure from 2 to 10, preferably from 4 to 8 MPa.

The hydrogenation is carried out in the presence of a hydrogenation/hydrotreating catalyst on a refractory support. Hydrogenation/hydrotreating catalysts are well known in the art. Generally the catalysts comprise a mixture of nickel, tungsten (wolfram) and molybdenum on a refractory support, typically alumina. The metals may be present in an amount from 0.0001 to 5, preferably from 0.05 to 3, most preferably from 1 to 3 weight % of one or more metals selected from the group consisting of Ni, W, and Mo based on the total weight of the catalyst (e.g. support and metal). One, and typically the most common, active form of the catalyst is the sulphide form so catalyst may typically be deposited as sulphides on the support. The sulphidizing step could be carried out ex-situ of the reactor or in-situ before the hydrotreating reaction starts. Suitable catalysts include Ni, Mo and Ni, W bimetallic catalysts in the above ranges.

The hydrogenation/hydrotreating catalyst also reduces the sulphur and nitrogen components (or permits their removal to low levels in the feed which will be passed to the cleavage process). Generally the hydrogenation/hydrotreating feed may contain from about 2000 to 7500 ppm of sulphur and from about 200 to 650 ppm of nitrogen. The stream leaving the hydrogenation/hydrotreating treatment should contain not more than about 100 ppm of sulphur and not more than about 20 ppm of nitrogen.

In the aromatic ring saturation (hydrogenation/hydrotreatment) step hydrogen is fed to the reactor to provide from 100 to 300, preferably from 100 to 200 kg of hydrogen per 1,000 kg of feedstock.

One of the considerations in practicing the present invention is the stability of the various aromatic ring compounds in the feed. A benzene ring has a high stability. A lot of energy and relatively narrow conditions are required for the saturation and cleavage of this aromatic ring in a single reactor. Hence, under the appropriate conditions this ring can be saturated and cleaved in a single reactor (e.g. concurrent reactions in one reactor or a "one step" process). One of the conditions is long residence time as is shown in examples 1 and 2. At long residence times or low WHSV benzene and methyl naphthalene may be converted to paraffins in a one reactor ("one step") process. Additionally the feed needs to be low in sulphur and nitrogen and relatively narrow in composition (e.g. the same or substantially the same aromatic compounds). The restrictions relative to the aromatic compound apply to a continuous flow type process or reactor. In a batch reactor, different aromatic compounds may be present. While this may present difficulties the one step process is useful to test cleavage catalysts. In the examples the catalyst is Pd on a zeolite support (ZSM-5).

For a fused multiple aromatic ring compound one of the aromatic rings is fairly quickly hydrogenated or partially hydrogenated (e.g. the non shared carbon atoms). In the second part of the process of the present invention the hydrogenated portion of the ring may then be cleaved. By cleaving the saturated portion of the ring (4 carbon chain) one gets a short chain alkyl compound and a single or fused polyaromatic compound with one less ring. The resulting fused polyaromatic compound may be recycled through the process. In a further embodiment the process of the present invention may be integrated with an ethylbenzene unit. Accordingly, rather than trying to hydrogenate the more stable benzene, it may be fed in an integrated process to an ethylbenzene unit.

The second part of the fused ring hydrogenation and cleavage process is a ring cleavage step. The product from the ring saturation step is subjected to a ring cleavage process to cleave the saturated portion of the ring. Generally the second step is conducted at a temperature of 200° C. to 600° C., preferably from 350° C. to 500° C. and a pressure from 1 to 12 MPa, preferably from 3 to 9 MPa.

In the ring cleavage step hydrogen is fed to the reactor at a rate of 50 to 200 kg, preferably 50 to 150 kg per 1,000 kg of feedstock.

The cleavage reaction takes place in the presence of a catalyst comprising a metallic component and a support as described below. The catalyst preferably comprises one or more metals selected from the group consisting of Pd, Rh, Ru, Ir, Os, Cu, Co, Ni, Pt, Fe, Zn, Ga, In, Mo, W or V. In the consecutive process (e.g. two step) any of the foregoing catalyst components could be used for the cleavage reaction.

In the catalyst for the ring cleavage process the metals may be used in an amount from 0.0001 to 5, preferably from 0.05 to 3, most preferably from 1 to 3 weight % of the metal based on the total weight of the catalyst (e.g. support and metal).

The ring cleavage catalyst is typically used on a support selected from the group consisting of aluminosilicates, silicoaluminophosphates, gallosilicates and the like.

Preferably, the support for the ring cleavage catalyst is selected from the group consisting of mordenite, cancrinite, gmelinite, faujasite and clinoptilolite and synthetic zeolites, the foregoing supports are in their acidic form (i.e. the acid or acidic component of the ring cleavage catalyst). The synthetic zeolites have the characteristics of ZSM-5, ZSM-11, ZSM-12, ZSM-23, MCM-22, SAPO-40, Beta, synthetic cancrinite, CIT-1, synthetic gmelinite, Linde Type L, ZSM-18, synthetic mordenite, SAPO-11, EU-1, ZSM-57, NU-87, and Theta-1, preferably ZSM-5, ZSM-11, ZSM-12, Beta, ZSM-23 and MCM-22. The hydrogenation metal component is exchanged into the pores or impregnated on the zeolite surface in amounts indicated above.

A good discussion of zeolites is contained in The Kirk Othmer Encyclopedia of Chemical Technology, in the third edition, volume 15, pages 638-668, and in the fourth edition, volume 16, pages 888-925. Zeolites are based on a framework of $AlO_4$ and $SiO_4$ tetrahedra linked together by shared oxygen atoms having the empirical formula $M_{2/n}O\ Al_2O_3\ y\ SiO_2\ w\ H_2O$ in which y is 2 or greater, n is the valence of the cation M, M is typically an alkali or alkaline earth metal (e.g. Na, K, Ca and Mg), and w is the water contained in the voids within the zeolite. Structurally zeolites are based on a crystal unit cell having a smallest unit of structure of the formula $M_{x/n}[(AlO_2)_x(SiO_2)_y]\ w\ H_2O$ in which n is the valence of the cation M, x and y are the total number of tetrahedra in the unit cell and w is the water entrained in the zeolite. Generally the ratio y/x may range from 1 to 100. The entrained water (w) may range from about 10 to 275. Natural zeolites, include mordenite (in the structural unit formula M is Na, x is 8, y is 40 and w is 24), faujasite (in the structural unit formula M may be Ca, Mg, $Na_2$, $K_2$, x is 59, y is 133 and w is 235), clinoptilolite (in the structural unit formula M is $Na_2$, x is 6, y is 30 and w is 24), cancrinite ($Na_8(AlSiO_4)_6(HCO_3)_2$, and gmelinite. Synthetic zeolites generally have the same unit cell structure except that the cation may in some instances be replaced by a complex of an alkali metal, typically Na and tetramethyl ammonium (TMA) or the cation may be a tetrapropylammonium (TPA). Synthetic zeolites include zeolite A (e.g., in the structural unit formula M is $Na_2$, x is 12, y is 12 and w is 27), zeolite X (e.g., in the structural unit formula M is $Na_2$, x is 86, y is 106 and w is 264), zeolite Y (e.g., in the structural unit formula M is $Na_2$, x is 56, y is 136 and w is 250), zeolite L (e.g., in the structural unit formula M is $K_2$, x is 9, y is 27 and w is 22), and zeolite omega (e.g., in the structural unit formula M is $Na_{6.8}TMA_{1.6}$, x is 8, y is 28 and w is 21). Preferred zeolites have an intermediate pore size typically from about 5 to 10 angstroms (having a modified constraint index of 1 to 14 as described in below). Synthetic zeolites are prepared by gel process (sodium silicate and alumina) or a clay process (kaolin) which form a matrix to which a zeolite is added. Some commercially available synthetic zeolites are described in U.S. Pat. No. 4,851,601. The zeolites may undergo ion exchange to entrain a catalytic metal or may be made acidic by ion exchange with ammonium ions and subsequent deammoniation (see the Kirk Othmer reference above).

The modified constraint index is defined in terms of the hydroisomerization of n-decane over the zeolite. At an isodecane yield of about 5% the modified constraint index (CI*) is defined as CI*=yield of 2-methylnonane/yield of 5-methylnonane.

The zeolites useful as supports for the ring cleavage catalyst also have a spaciousness index (SI)≦20. This ratio is defined relative to the hydrocracking of $C_{10}$ cycloalkanes such as butylcyclohexane over the zeolite. SI=yield of isobutane/yield of n-butane.

Some useful zeolites include synthetic zeolites having the characteristics of ZSM-5, ZSM-11, ZSM-12, ZSM-23 and MCM-22, preferably ZSM-11, ZSM-12, ZSM-23, Beta and MCM-22.

The product stream from the process of the present invention comprises a hydrocarbon stream typically comprising less than 5, preferably less than 2 weight % of methane from 30 to 90 weight % of $C_{2-4}$ hydrocarbons; from 45 to 5 weight % of $C_{5+}$ hydrocarbons (paraffins) and from 20 to 0 weight % of mono-aromatic compounds. Depending on how the processes are conducted (e.g. LHSV or WHSV in the second stage of the process and support and the metal components of the ring opening catalyst) the composition of the resulting product stream may be shifted. At lower LHSV in the second step more of the aromatics are consumed so that the aromatic component may be reduced to virtually zero and there is a corresponding increase in the $C_{2-4}$ components (70 to 90 weight %) and the $C_{5+}$ components (10 to 20 weight %). At higher LHSV there is an increase in the aromatic components (5 to 20 weight %) and a corresponding decrease in the $C_{2-4}$ (30 to 45 weight %) and $C_{5+}$ (40 to 50 weight %) components. One of ordinary skill in the art may vary the conditions of operation of the process to change the composition of the product stream depending on factors such as market demand and the availability of other units for integration of the product stream such as an ethylbenzene unit, etc.

In further embodiments of the present invention the process may be integrated with a hydrocarbon cracker for olefins production. The lower alkane stream from the present invention is fed to the cracker to generate olefins and the hydrogen generated from the cracker is used as the hydrogen feed for the process of the present invention. In a further embodiment the present invention may be integrated with either an ethylbenzene unit or an ethylbenzene unit together with a steam cracker for olefin production. The aromatic product stream (e.g. benzene) may be used as feed for the ethylbenzene unit together with ethylene from the olefin cracker.

The catalyst beds used in the present invention may be fixed or fluidized beds, preferably fixed. The fluidized beds may be a recirculating bed which is continuously regenerated.

Figure 3:
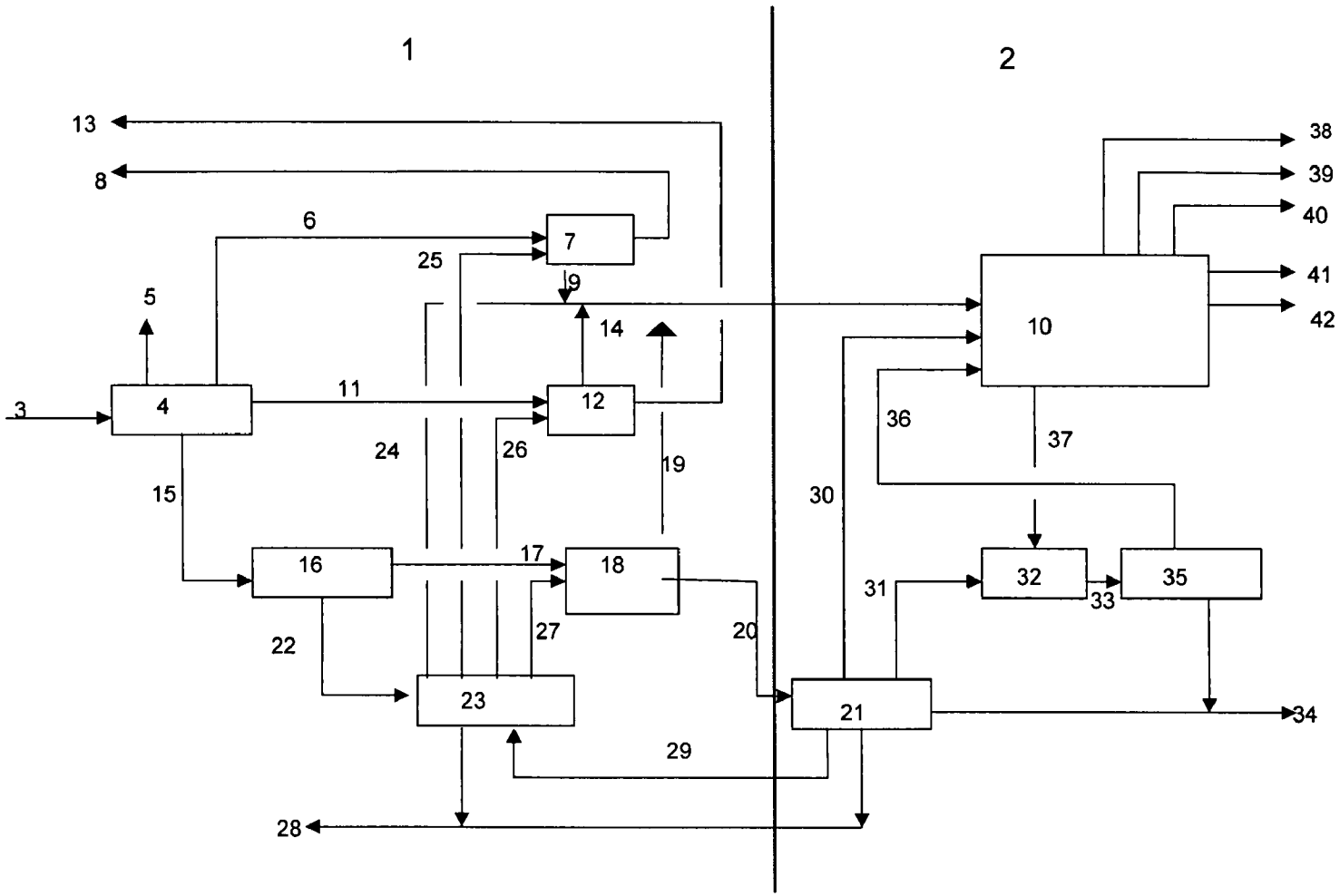
FIG. 3 is a simplified schematic process diagram of an integrated oil sands upgrader, an aromatic compound hydrogenation/ring opening process and a hydrocarbon cracker.

An integrated oil sand upgrader, aromatic saturation, aromatic cleavage and hydrocarbon cracker process will be outlined in conjunction with FIG. 3.

The left hand side 2 of the figure schematically shows an oil sands upgrader 1 and the right hand side of the FIG. 3 schematically shows a combination of an aromatic saturation unit, a ring cleavage unit and a hydrocarbon cracker.

Bitumen 3 from the oil sands, generally diluted with a hydrocarbon diluent to provide for easier handling and transportation, is fed to a conventional distillation unit 4. The diluent stream 5 is recovered from the distillation unit and recycled back to the oil sands separation unit or upgrader (separation of oil from particulates (rocks, sand, grit etc.)). A naphtha stream 6 from distillation unit 4 is fed to a naphtha hydrotreater unit 7. Hydrotreated naphtha 8 from naphtha hydrotreater 7 is recovered. The overhead gas stream 9 is a light gas/light paraffin stream (e.g methane, ethane, propane, and butane), is fed to hydrocarbon cracker 10.

Diesel stream 11 from the distillation unit 4 is fed to a diesel hydrotreater unit 12. The diesel stream 13 from the diesel hydrotreater unit 12 is recovered. The overhead stream 14 is a light gas light paraffin stream (methane, ethane, propane, and butane) and combined with light gas light paraffin stream 9 and fed to the hydrocarbon cracker 10. The gas oil stream 15 from distillation unit 4 is fed to a vacuum distillation unit 16. The vacuum gas oil stream 17 from vacuum distillation unit 16 is fed to a gas oil hydrotreater 18. Light gas stream 19 (methane, ethane, and propane) from the gas oil hydrotreater is combined with light gas streams 9 and 14 and fed to hydrocarbon cracker 10. The hydrotreated vacuum gas oil 20 from the vacuum gas oil hydrotreater 18 is fed to a NHC unit (NOVA Chemicals Heavy oil cracking unit—a catalytic cracker) unit 21.

The bottom stream 22 from the vacuum distillation unit 16 is a vacuum (heavy) residue and is sent to a delayed coker 23. The delayed coker produces a number of streams. There is a light gas light paraffin stream 24 (methane, ethane, propane, and butane) which is combined with light gas light paraffin streams 9, 14, 24 and 19 and sent to hydrocarbon cracker 10. A naphtha stream 25 sent to naphtha hydrotreater unit 7 to produce a naphtha stream 8 which is recovered and a light gas light paraffin stream 9 which is sent to the hydrocarbon cracker 10. Diesel stream 26 is sent to diesel hydrotreater unit 12 to produce hydrotreated diesel 13 which is recovered and light gas light paraffin stream 14 which is fed to hydrocarbon cracker 10. A gas oil stream 27 is fed to a vacuum gas oil hydrotreater unit 18 resulting in a hydrotreated gas oil stream 20 which is fed to NHC unit 21. The bottom from the delayed coker 23 is coke 28.

The NHC unit 21 also produces a bottom stream of coke 28. A slurry oil stream 29 from the NHC unit 21 is fed back to the delayed coker 23. A light gas or light paraffins (methane, ethane, propane and butane) stream 30 from NHC unit 21 is fed to hydrocarbon cracker 10. A cycle oil stream (both heavy cycle oil and light cycle oil) 31 from NHC unit 21 is fed to an aromatic saturation unit 32 as described above. A gasoline fraction 34 from the NHC unit 21 is recovered separately. A partially hydrogenated cycle oil (heavy cycle oil and light cycle oil in which at least one ring is saturated) 33 from the aromatic saturation unit 32 is fed to an aromatic ring cleavage unit 35. Although not shown in this schematic figure both aromatic saturation unit 32 and aromatic ring cleavage unit 35 are fed with hydrogen which may be from the hydrocarbon cracker 10. One stream from the aromatic ring cleavage unit is a gasoline stream 34 that is combined with the gasoline stream from the NHC (NOVA Heavy Oil cracker) unit 21. The other stream 36 from the aromatic ring cleavage unit 35 is a paraffinic stream which is fed to hydrocarbon cracker 10.

The hydrocarbon cracker 10 produces a number of streams including an aromatic stream 37, which may be fed back to the aromatic saturation unit 32; a hydrogen stream 38, which may be used in the process of the present invention (e.g. as feed for the aromatic ring saturation unit 32 and/or the aromatic ring cleavage unit 35); methane stream 39; ethylene stream 40; propylene stream 41; and a stream of mixed $C_4$'s 42.

As noted above the integrated process could also include an ethylbenzene unit and a styrene unit. The ethylbenzene unit would use aromatic streams and ethylene from the cracker and the styrene unit would use resulting ethylbenzene and generate a stream of styrene and hydrogen.

The present invention will be illustrated by the following non limiting examples.

The examples show a process in which methyl naphthalene is first hydrogenated and then cracked in the presence of a Pd catalyst on a medium sized zeolite in a single reactor. The difficulty with this process is that the complete hydrogenation of the fused aromatic rings is very slow due to adsorptive hindrance. After both rings were saturated the ring cleavage occurred.

EXAMPLE 1

The reactor was charged with 500 mg dry catalyst. Before starting the reaction, the catalyst was pretreated in flows of air (16 h, 150 $cm^3$ $min^{-1}$), nitrogen (1 h, 150 $cm^3$ $min^{-1}$) and hydrogen (4 h, 240 $cm^3$ $min^{-1}$) at 300° C. to yield a bifunctional catalyst with $m_{Pd}/m_{zeolite,\,dry}$=0.2%. The hydrogen carrier gas was loaded with 1-methylnaphthalene (1-M-Np) by passing it over a fixed bed of an inert solid and glass beads containing the aromatic compound at 80° C. ($p_{aromatic}$=300 Pa). This feed mixture was led to the reactor holding the activated catalyst at the reaction conditions of 400° C. and 6 MPa. Product samples were taken from the reactor effluent after expansion to ambient pressure. A conversion of 100% of the two-ring aromatic compound was achieved. The product yields are shown in Table 1.

TABLE 1

Product Yields (Based on Mass Fractions) Obtained in the Conversion of 1-M-Np On 0.2Pd/H-ZSM-5 at 6 MPa and 400° C.

| | Product Yields (Based on Mass Fractions) |
|---|---|
| Methane | 5 wt.-% |
| Ethane | 13 wt.-% |
| Propane | 41 wt.-% |
| 2-methylpropane | 19 wt.-% |
| n-butane | 15 wt.-% |
| 2-methylbutane | 5 wt.-% |
| n-pentane | 3 wt.-% |

The experiment in Example 1 was continued for 167 h. In FIG. 1 the conversion of 1-methylnaphthalene at 400° C. and 6 MPa is displayed as a function of time-on-stream. As shown, the catalyst is highly stable during 167 h on-stream.

EXAMPLE 2

In this section, the influence of the zeolite pore structure of ZSM-5, ZSM-11, ZSM-12, ZSM-23 and MCM-22 on the conversion of 1-M-Np was studied. As shown in Table 2, the reaction over the Pd-containing zeolites leads to the following products: methane, ethane, propane, iso-butane, n-butane, 2-methylbutane, n-pentane, dimethylbutanes, methylpentanes, 3,3-dimethylpentane and methylcyclohexane.

TABLE 2

Product Yields (Based on Mass Fractions) Obtained in the Conversion of 1-M-Np on Different Zeolites at 6.0 MPa and 400° C.

| | 0.2Pd/H-ZSM-5 | 0.2Pd/H-ZSM-11 | 0.2Pd/H-ZSM-12 | 0.2Pd/H-ZSM-23 | 0.2Pd/H-MCM-22 |
|---|---|---|---|---|---|
| $n_{Si}/n_{Al}$ | 19 | 34 | 60 | 48 | 14 |
| $X_{1\text{-}M\text{-}Np}$/% | 100 | 97 | 96 | 100 | 96 |
| $Y_{methane}$/wt.-% | 5 | 2 | 1 | 2 | 2 |
| $Y_{ethane}$/wt.-% | 13 | 7 | 3 | 22 | 25 |
| $Y_{propane}$/wt.-% | 41 | 36 | 27 | 31 | 33 |
| $Y_{2\text{-}methylpropane}$/wt.-% | 19 | 15 | 25 | 16 | 17 |
| $Y_{n\text{-}butane}$/wt.-% | 15 | 22 | 16 | 13 | 8 |
| $Y_{2\text{-}methylbutane}$/wt.-% | 4 | 9 | 11 | 3 | 3 |
| $Y_{n\text{-}pentane}$/wt.-% | 3 | 4 | 7 | 2 | 3 |
| $Y_{2,2\text{-}dimethylbutane}$/wt.-% | 0 | 2 | 1 | 5 | 2 |
| $Y_{2,3\text{-}dimethylbutane}$/wt.-% | 0 | 0 | 1 | 4 | 0 |
| $Y_{2\text{-}methylpentane}$/wt.-% | 0 | 0 | 2 | 0 | 0 |
| $Y_{3\text{-}methylpentane}$/wt.-% | 0 | 0 | 2 | 0 | 0 |
| $Y_{3,3\text{-}dimethylpentane}$/wt.-% | 0 | 0 | 0 | 0 | 2 |
| $Y_{methylcyclohexane}$/wt.-% | 0 | 0 | 0 | 2 | 1 |
| $Y_{C_{2+}\text{-}n\text{-}alkanes}$/wt.-% | 72 | 69 | 53 | 68 | 69 |
| $Y_{iso\text{-}alkanes}$/wt.-% | 23 | 26 | 42 | 28 | 24 |

On zeolite 0.2Pd/H-ZSM-5 at 400° C. and 6.0 MPa, 1-M-Np is converted with a $C_{2+}$-n-alkane (i.e., n-alkanes with two and more carbon atoms) yield of 72 wt.-%. This fraction consists of ethane (13 wt.-%), propane (41 wt.-%), n-butane (15 wt.-%) and n-pentane (3 wt.-%). Only slightly lower yields for $C_{2+}$-n-alkanes (69 wt.-%) are obtained on zeolite 0.2Pd/H-ZSM-11.

However, on zeolite 0.2Pd/H-ZSM-12, the yields to the desired $C_{2+}$-n-alkane products are much lower (53 wt.-%). The by-products on zeolite 0.2Pd/H-ZSM-5 are the branched alkanes 2-methylpropane (19 wt.-%) and 2-methylbutane (4 wt.-%). On zeolite 0.2Pd/H-ZSM-12, the yield of iso-alkanes other than iso-butane and iso-pentane is 6 wt.-% (2,2-dimethylbutane: 1 wt.-%, 2,3-dimethylbutane: 1 wt.-%, 2-methylpentane: 2 wt.-%, and 3-methylpentane: 2 wt.-%). On the zeolite catalysts 0.2Pd/H-ZSM-23 and 0.2Pd/H-MCM-22, a $C_{2+}$-n-alkane yield of 68 and 69 wt.-% is obtained, respectively: ethane (22 and 25 wt.-%), propane (31 and 33 wt.-%), n-butane (13 and 8 wt.-%) and n-pentane (2 and 3 wt.-%). The by-products on the two zeolites are branched alkanes with a yield of 28 and 24 wt.-%, respectively.

From Table 2 ZSM-5, ZSM-11 and ZSM-12 supported catalysts tend to produce more propane and higher paraffins. ZSM-23 and MCM-22 supported catalyst produce higher amounts of ethane which may be a better stream for ethane type crackers.

EXAMPLE 3

Figure 2:
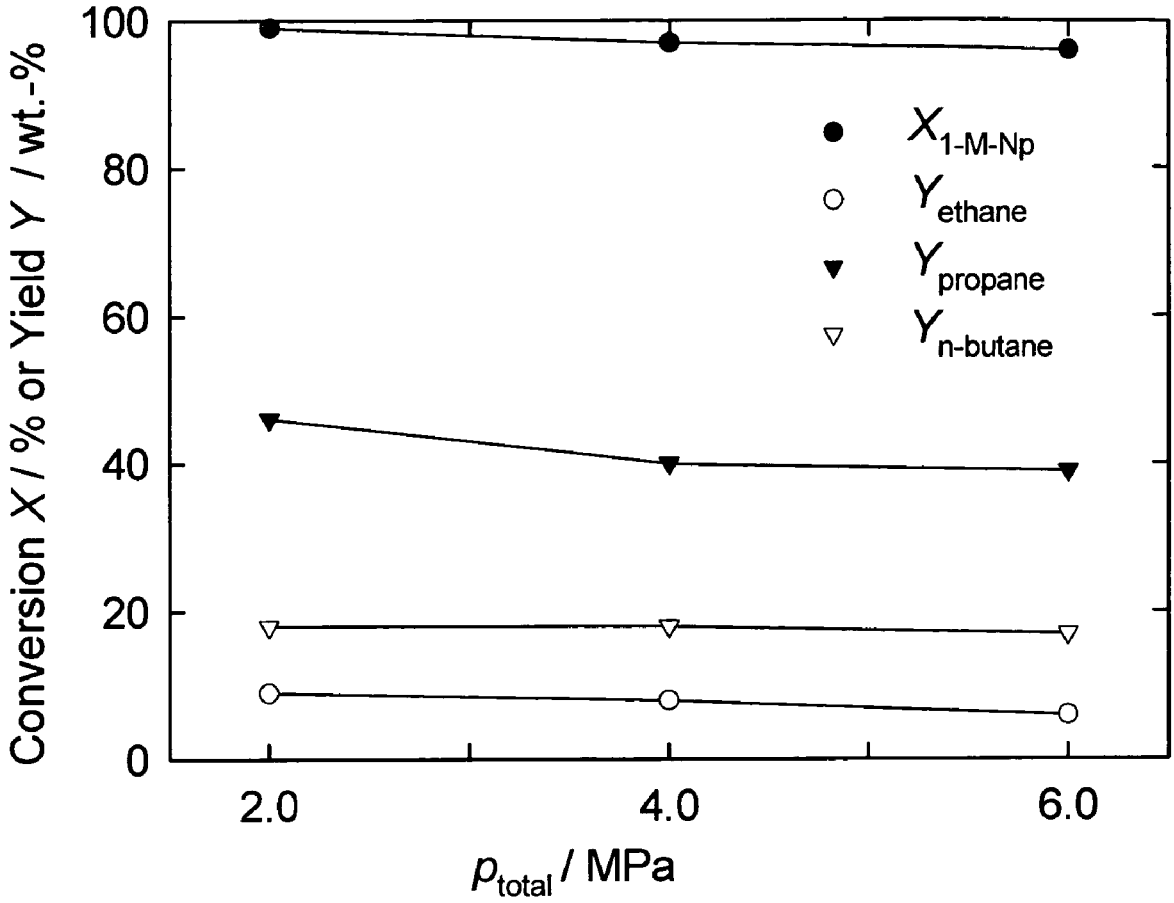
FIG. 2 shows the conversion of methylnaphthalene and the product yields as a function of total pressure in accordance with example 2.

The influence of the total pressure ($p_{total}$) on the catalytic performance of zeolite 0.2Pd/H-ZSM-11 was studied at T=400° C. and WHSV=0.003 $h^{-1}$. The conversion and the product distribution are given in FIG. 2. The conversion of 1-methylnaphthalene is between 99 and 93% in the pressure range studied. Increasing the pressure from 2.0 to 6.0 MPa caused a decrease in the yield of the desired products from 73 to 61 wt.-%. The yield of ethane decreased from 9 to 5 wt.-%, the yield of propane from 46 to 39 wt.-% and the yield of n-butane from 18 to 17 wt.-%. Furthermore, the $Y_{iso\text{-}butane}/Y_{n\text{-}butane}$-ratio changed from 0.7 to 1.0. The formation of the iso-alkanes is obviously preferred at higher total pressures.

EXAMPLE 4

The ring saturation and ring opening process of the present invention—(Aromatic Ring Cleavage—ARORINCLE) comprises of two steps: in the first step the total feed—Gas Oil (GO), is hydrotreated. In this step the catalyst poisons sulfur and nitrogen are removed and aromatics are saturated to naphthenics. This step is there mostly to protect the second step metal catalyst, typically noble metal, from the catalyst poisons. The liquid product from the first step is separated from the gas stream (methane), and this liquid product is used as feed for the second step, in which the naphthenic and aromatic rings are opened to form valuable light paraffins ($C_2$ to $C_4$).

The experimental runs in the laboratory were carried out in a fixed bed-reactor in the up flow mode. Because this unit contains only one reactor, all the runs were done in such a way that the first step is carried out. Thereafter, another catalyst was reloaded for the second step reaction to take place. The catalyst used for the first step is a stacked catalyst bed: the first catalyst bed is a $NiW/Al_2O_3$ catalyst and the second is a $NiMo/Al_2O_3$ catalyst. Both are commercially available catalysts. The catalysts were sulfided in-situ prior to the start of run per standard procedure.

After the sulfiding is completed, the catalyst bed is heated up to the desired reaction temperature at a heating rate of 30° C. per hour and the Gas Oil (GO) is introduced into the reactor.

The liquid product from the reactor is separated from the gas in the gas separator, collected in the glass container and kept in the laboratory fridge. After the sufficient amount of hydrotreated GO is collected the liquid product is bubbled through with the nitrogen to separate the rest of the trapped $H_2S$ from the liquid product. The collected and gas free GO is then introduced into the reactor, which is loaded with the Pd/Zeolite catalyst. Before starting this second step reaction, the catalyst was initially pretreated in flows of air (16 h, 150 $cm^3\ min^{-1}$), nitrogen (1 h, 150 $cm^3\ min^{-1}$) and hydrogen (4 h, 240 $cm^3\ min^{-1}$) at 300° C. at atmospheric pressure.

The following examples show 2 cases of the ARORINCLE process carried out at different conditions. The feed for these runs was Gas Oil derived from oil sands with a boiling point range of 190° C. and 548° C., which was pre-hydrotreated to reduce the content of heteroatoms. The difference between Example 4A and 4B is that in 4B, the LHSV for the second stage reaction was reduced (from 0.5 to 0.2 $h^{-1}$), resulting in higher paraffins ($C_2$ to $C_4$) and saturates yield. The process can be adjusted for high paraffins plus saturates yield with low BTX yields or vice versa, as desired, depending on market needs.

The results of runs 4A and 4B are set out in the tables below.

TABLE 4 A

| | 1. Step: HDS, HDN, HDA | | 2. Step: Ring Cleavage | |
|---|---|---|---|---|
| T [° C.] | 410 | | 380 | |
| P [psi] | 1000 | | 900 | |
| LHSV [$h^{-1}$] | 0.5 | | 0.5 | |
| | Feed wt % | Product wt % | Feed wt % | Product wt % |
| Methane | 0 | 0.70 | 0 | 0.69 |
| Total Light Paraffins | 0 | 3.5 | 0 | 32.48 |
| Ethane | | 1.01 | | 3.15 |
| Propane | | 1.57 | | 16.18 |
| n-Butane | | 0.30 | | 7.78 |
| Iso-Butane | | 0.26 | | 5.37 |
| $H_2S$ | | 0.28 | | |
| Ammonia | | 0.08 | | |
| Total Liquid Saturates | 46.2 | 54.8 | 57.2 | 47.56 |
| $C_5$ | | | | 15.62 |
| $C_6$ | | | | 8.47 |
| $C_7$ | | | | 3.17 |
| $C_8$ | | | | 1.17 |
| $C_9$ | | | | 2.52 |
| $C_{10}$ | | | | 1.57 |
| $<C_{10}$ | | | | 15.04 |
| Total Aromatics | 53.8 | 41.0 | 42.8 | 19.27 |
| Benzene | | | | 3.29 |
| Toluene | | | | 5.49 |
| Xylenes | | | | 4.59 |
| Ethyl-Benzene | | | | 1.34 |
| $C_9$-Aromatics | | | | 4.56 |
| Monoaromatics | 27.6 | 30.18 | 31.5 | |
| Diaromatics | 11.6 | 7.57 | 7.90 | |
| Polyaromatics | 14.6 | 3.25 | 3.4 | |
| Heteroatoms | | | | |
| Sulfur [ppm] | 2800 | <100 | <100 | |
| Nitrogen [ppm] | 867.1 | | | |

TABLE 4B

| | 1. Step: HDS, HDN, HDA | | 2. Step: Ring Cleavage | |
|---|---|---|---|---|
| T [° C.] | 410 | | 380 | |
| P [psi] | 1000 | | 900 | |
| LHSV [$h^{-1}$] | 0.5 | | 0.2 | |
| | Feed wt % | Product wt % | Feed wt % | Product wt % |
| Methane | 0 | 0.70 | 0 | 1.41 |
| Total Light Paraffins | 0 | 3.5 | 0 | 37.82 |
| Ethane | | 1.01 | | 4.50 |
| Propane | | 1.57 | | 16.65 |
| n-Butane | | 0.30 | | 10.34 |
| Iso-Butane | | 0.26 | | 6.33 |
| $H_2S$ | | 0.28 | | |
| Ammonia | | 0.08 | | |
| Total Liquid Saturates | 46.2 | 54.8 | 57.2 | 55.48 |
| $C_5$ | | | | 12.78 |
| $C_6$ | | | | 7.49 |
| $C_7$ | | | | 4.02 |
| $C_8$ | | | | 3.33 |
| $C_9$ | | | | 2.36 |
| $C_{10}$ | | | | 9.97 |
| $<C_{10}$ | | | | 15.53 |

TABLE 4B-continued

| | | | | |
|---|---|---|---|---|
| Total Aromatics | 53.8 | 41.0 | 42.8 | 5.29 |
| Benzene | | | | 0.12 |
| Toluene | | | | 0.20 |
| Xylenes | | | | 0.65 |
| Ethyl-Benzene | | | | 0.35 |
| $C_9$-Aromatics | | | | 3.97 |
| Monoaromatics | 27.6 | 30.18 | 31.5 | |
| Diaromatics | 11.6 | 7.57 | 7.90 | |
| Polyaromatics | 14.6 | 3.25 | 3.4 | |
| Heteroatoms | | | | |
| Sulfur [ppm] | 2800 | <100 | <100 | |
| Nitrogen [ppm] | 867.1 | | | |

Based on the results in Table 4A a computer simulation of the ARORINCLE process was carried out for the conditions set out in Table 4A. For a feed of 1 metric ton (e.g. 1,000 kg) of gas oil and 120 kg of $H_2$ there would be separated in the liquid separator 7.84 kg of methane, 35.17 kg of $C_{2-4}$ products (e.g. separately recovered), $H_2S$ and $NH_3$. The liquid separator would contain (1000+120−(7.84+35.17))=1076.89 kg of liquid feed (saturates and aromatics). This would be fed to the second reactor together with 75 kg of $H_2$ and the resulting product stream would comprise 7.92 kg of $H_2$; 372.86 kg of $C_{2-4}$ products, 545.97 kg of $C_5^+$ (paraffins) and 221.21 kg of benzene, toluene and xylene (BTX).

Based on the results in table 4B a computer simulation of the ARORINCLE process was carried out for the conditions set out in table 4B. For a feed of 1 metric ton (e.g. 1,000 kg) of gas oil and 120 kg of $H_2$ there would be separated in the liquid separator 7.84 kg of methane, 35.17 kg of $C_{2-4}$ products (e.g. separately recovered), $H_2S$ and $NH_3$. The liquid separator would contain (1000+120−(7.84+35.17))=1076.89 kg of liquid feed (saturates and aromatics). This would be fed to the second reactor together with 100 kg of $H_2$ and the resulting product stream would comprise 16.54 kg of $H_2$; 443.61 kg of $C_{2-4}$ products 650.76 kg of $C_5^+$ (paraffins) and 62.05 kg of benzene, toluene and xylene (BTX).

What is claimed is:

1. A process for hydrocracking a feed comprising not less than 20 weight % of one or more aromatic compounds containing at least two fused aromatic rings which compounds are unsubstituted or substituted by up to two $C_{1-4}$ alkyl radicals to produce a product stream comprising not less than 35 weight % of a mixture of $C_{2-4}$ alkanes comprising:

(i) passing said feed stream to a ring saturation unit at a temperature from 300° C. to 500° C. and a pressure from 2 to 10 MPa together with from 100 to 300 kg of hydrogen per 1,000 kg of feedstock over an aromatic hydrogenation catalyst to yield a resulting stream in which not less than 60 weight % of said one or more aromatic compounds containing at least two rings which compounds are unsubstituted or substituted by up to two $C_{1-4}$ alkyl radicals at least one of the aromatic rings has been completely saturated;

(ii) passing the resulting stream to a ring cleavage unit at a temperature from 200° C. to 600° C. and a pressure from 1 to 12 MPa together with from 50 to 200 kg of hydrogen per 1,000 kg of said resulting stream over a ring cleavage catalyst to product the product stream; and (iii) separating the product stream into a $C_{2-4}$ alkanes stream, a liquid paraffinic stream and an aromatic stream.

2. The process according to claim 1, wherein the aromatic hydrogenation catalyst comprises from 0.0001 to 5 weight % of one or more metals selected from the group consisting of Ni, W, and Mo.

3. The process according to claim 2, wherein the ring cleavage catalyst comprises from 0.0001 to 5 weight % of one or more metals selected from the group consisting of Pd, Ru, Is, Os, Cu, Co, Ni, Pt, Fe, Zn, Ga, In, Mo, W, and V on a support having a spaciousness index less than or equal to 20 and a modified constraint index of 1 to 14.

4. The process according to claim 3 wherein in step (i) the temperature is from 350° C. to 450° C. and a pressure from 4 to 8 MPa.

5. The process according to claim 4 wherein in step (i) hydrogen is fed to the ring saturation unit at a rate of 100 to 200 kg of hydrogen per 1,000 kg of feedstock.

6. The process according to claim 5, wherein in step (ii) the temperature is from 350° C. to 500° C. and a pressure from 3 to 9 MPa.

7. The process according to claim 6 wherein in step (ii) hydrogen is fed to the ring saturation unit at a rate of 50 to 150 kg of hydrogen per 1,000 kg of feedstock.

8. The process according to claim 7, wherein in the aromatic hydrogenation catalyst comprising a refractory supported which is alumina.

9. The process according to claim 8, wherein in the ring cleavage catalyst comprising an acid component which is selected from the group consisting of aluminosilicates, silicoaluminophosphates and gallosilicates.

10. The process according to claim 9, wherein the acid component of the ring cleavage catalyst is selected from the group consisting of mordenite, cancrinite, gmelinite, faujasite and clinoptilolite and synthetic zeolites.

11. The process according to claim 10, wherein in the aromatic hydrogenation catalyst comprises from 0.05 to 3 weight % of one or more metals selected fro the group consisting of Ni, W and Mo, based on the total weight of the catalyst.

12. The process according to claim 11, wherein the ring cleavage catalyst comprises from 0.05 to 3 weight % of one or more metals selected from the group consisting of Pd, Ru, Pt, Mo, W, and V.

13. The process according to claim 12, wherein the ring cleavage catalyst comprising the support which is selected from the group of synthetic zeolites having the characteristics of ZSM-5, ZSM-11, ZSM-12, ZSM-23, Beta and MCM-22.

14. The process according to claim 13, wherein the product stream comprises not less than 45 weight % of one or more $C_{2-4}$ alkanes.

15. The process according to claim 1, integrated with a hydrocarbon cracker wherein the hydrogen produced by said cracker is fed to the ring saturation unit and the ring cleavage unit and the $C_{2-4}$ alkane stream is used as feed to the hydrocarbon cracker.

16. The process according to claim 15, further integrated with an ethylbenzene unit wherein the aromatic product stream is fed to the ethylbenzene unit.

17. The process according to claim 15, further integrated with an ethylbenzene unit wherein part of the ethylene from the cracker is also fed to the ethylbenzene unit.

18. In an integrated process for the upgrading of an initial hydrocarbon comprising not less than 5 weight % of one or more aromatic compounds containing at least two fused aromatic rings which compounds are unsubstituted or substituted by up to two $C_{1-4}$ alkyl radicals comprising subjecting the hydrocarbon to several distillation steps to yield an intermediate stream comprising not less than 20 weight % of one or more aromatic compounds containing at least two fused aromatic rings which compounds are unsubstituted or substituted by up to two $C_{1-4}$ alkyl radicals the improvement comprising:

(i) passing said intermediate stream to a ring saturation unit at a temperature from 300° C. to 500° C. and a pressure from 2 to 10 MPa together with from 100 to 300 kg of hydrogen per 1,000 kg of feedstock over an aromatic hydrogenation catalyst to yield a resulting stream in which in not less than 60 weight % of said one or more aromatic compounds containing at least two rings which compounds are unsubstituted or substituted by up to two $C_{1-4}$ alkyl radicals at least one of the aromatic rings has been completely saturated;

(ii) passing the resulting stream to a ring cleavage unit at a temperature from 200° C. to 600° C. and a pressure from 1 to 12 MPa together with from 50 to 200 kg of hydrogen per 1,000 kg of said resulting stream over a ring cleavage catalyst to produce a resulting product stream; and (iii) separating the resulting product into a $C_{2-4}$ alkanes stream, a liquid paraffinic stream and an aromatic stream wherein the resulting product stream comprises not less than 35 weight % of a mixture of $C_{2-4}$ alkanes.

19. The process according to claim 18, wherein the aromatic hydrogenation catalyst comprises from 0.0001 to 5 weight % of Mo and from 0.0001 to 5 weight % of Ni deposited on a refractory support.

20. The process according to claim 19, wherein the ring cleavage catalyst comprises from 0.0001 to 5 weight % of one or more metals selected from the group consisting of Pd, Ru, Pt, Mo, W, and V on a support having a spaciousness index less than or equal to 20 and a modified constraint index of 1 to 14.

21. The process according to claim 20, wherein in step (i) the temperature is from 350° C. to 450° C. and a pressure from 4 to 8 MPa.

22. The process according to claim 21, wherein in step (i) hydrogen is fed to the ring saturation unit at a rate of 100 to 200 kg of hydrogen per 1,000 kg of feedstock.

23. The process according to claim 22, wherein in step (ii) the temperature is from 350° C. to 500° C. and a pressure from 3 to 9 MPa.

24. The process according to claim 23, wherein in step (ii) hydrogen is fed to the ring saturation unit at a rate of 50 to 150 kg of hydrogen per 1000 kg of feedstock.

25. The process according to claim 24, wherein in the aromatic hydrogenation catalyst comprising a refractory supported which is alumina.

26. The process according to claim 25, wherein the ring cleavage catalyst comprising the support which is selected from the group consisting of aluminosilicates, silicoaluminophosphates and gallosilicates.

27. The process according to claim 26, wherein the ring cleavage catalyst is selected from the group consisting mordenite, cancrinite, gmelinite, faujasite and clinoptilolite and synthetic zeolites.

28. The process according to claim 27, wherein in the aromatic hydrogenation catalyst comprises from 0.05 to 3 weight % of one or more metals selected from the group consisting of Ni, W and Mo, based on the total weight of the catalyst.

29. The process according to claim 28, wherein the ring cleavage catalyst comprises from 0.05 to 3 weight % of one or more metals selected from the group consisting of Pd, Ru, Is, Os, Cu, Co, Ni, Pt, Fe, Zn, Ga, In, Mo, W, and V on the support having a spaciousness index less than or equal to 20 and a modified constraint index of 1 to 14.

30. The process according to claim 29, wherein the ring cleavage catalyst comprising the support which is selected from the group of synthetic zeolites having the characteristics of ZSM-5, ZSM-11, ZSM-12, ZSM-23, Beta and MCM-22.

31. The process according to claim 30, wherein the initial hydrocarbon is derived from one or more sources selected from the group consisting of shale oils, tar sands and oil sands.

* * * * *